US010392868B2

(12) United States Patent
Xia et al.

(10) Patent No.: US 10,392,868 B2
(45) Date of Patent: Aug. 27, 2019

(54) MILLING WELLBORE CASING

(71) Applicant: SCHLUMBERGER TECHNOLOGY CORPORATION, Sugar Land, TX (US)

(72) Inventors: Sike Xia, Houston, TX (US); Jeffrey N. Dodge, Kingwood, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 411 days.

(21) Appl. No.: 15/017,918

(22) Filed: Feb. 8, 2016

(65) Prior Publication Data

US 2017/0089146 A1 Mar. 30, 2017

Related U.S. Application Data

(60) Provisional application No. 62/234,703, filed on Sep. 30, 2015.

(51) Int. Cl.
*E21B 10/56* (2006.01)
*E21B 29/00* (2006.01)
*E21B 10/567* (2006.01)

(52) U.S. Cl.
CPC ..... *E21B 10/5673* (2013.01); *E21B 29/002* (2013.01); *E21B 2010/566* (2013.01)

(58) Field of Classification Search
CPC ..... E21B 10/567; E21B 10/5673; E21B 2010/561; E21B 29/002
See application file for complete search history.

(56) References Cited

U.S. PATENT DOCUMENTS 4,984,488 A * 1/1991 Lunde ..... B23B 5/16 166/55.6
5,012,863 A 5/1991 Springer
5,038,859 A * 8/1991 Lynde ..... E21B 10/46 166/55.6
5,070,952 A 10/1991 Neff
5,086,838 A * 2/1992 Cassel ..... B23B 5/16 166/55.6
5,373,900 A 12/1994 Lynde et al.
5,456,312 A 10/1995 Lynde et al.
(Continued)

FOREIGN PATENT DOCUMENTS

WO WO9711251 A1 3/1997

OTHER PUBLICATIONS

International Search Report and Written Opinion issued in International Patent Application No. PCT/US2016/052728 dated Jan. 5, 2017, 17 pages.

(Continued)

*Primary Examiner* — Blake E Michener

(57) ABSTRACT

A cutting insert for milling wellbore casing in a downhole environment includes a body having a cutting face and a chip-breaking face. The cutting face and chip-breaking face are oriented at a face angle relative to each other, the face angle being between 75° and 130°. As the wellbore casing is milled, swarf is formed and work hardened. Further deformation of the swarf and movement along, or in contact with, the chip-breaking face breaks the swarf into chips that are readily flushed away or transported within the wellbore.

21 Claims, 8 Drawing Sheets

(56) References Cited

U.S. PATENT DOCUMENTS 5,582,258 A * 12/1996 Tibbitts ..... E21B 10/567 175/429
5,626,189 A * 5/1997 Hutchinson ..... E21B 29/00 166/55.6
5,732,770 A 3/1998 Beeman
5,778,995 A 7/1998 McGarian
5,908,071 A * 6/1999 Hutchinson ..... E21B 2/00 166/55.6
5,979,571 A 11/1999 Scott et al.
5,984,005 A 11/1999 Hart et al.
5,992,549 A * 11/1999 Fuller ..... E21B 10/55 175/431
6,065,554 A * 5/2000 Taylor ..... E21B 10/5673 175/430
6,170,576 B1 1/2001 Brunnert et al.
6,328,117 B1 * 12/2001 Berzas ..... E21B 10/55 175/431
7,108,064 B2 9/2006 Hart et al.
8,087,478 B2 * 1/2012 Patel ..... E21B 10/5673 175/430
8,876,440 B2 11/2014 Nam et al.
2001/0030063 A1 * 10/2001 Dykstra ..... E21B 10/42 175/57
2006/0060391 A1 * 3/2006 Eyre ..... C22C 26/00 175/434
2010/0084198 A1 * 4/2010 Durairajan ..... E21B 10/55 175/430
2011/0259642 A1 * 10/2011 DiGiovanni ..... B24D 18/00 175/57
2014/0116788 A1 * 5/2014 Patel ..... E21B 10/567 175/428
2014/0166305 A1 * 6/2014 Grigor ..... E21B 29/002 166/376
2014/0332200 A1 11/2014 Ruttley
2015/0167394 A1 6/2015 Xia et al.
2015/0376966 A1 12/2015 Balasubramanian et al.

OTHER PUBLICATIONS

International Preliminary Report on Patentability issued in International Patent Application No. PCT/US2016/052728 dated Apr. 12, 2018, 13 pages.

* cited by examiner

MILLING WELLBORE CASING

CROSS-REFERENCE TO RELATED APPLICATIONS

This application claims the benefit of, and priority to, U.S. Patent Application Ser. No. 62/234,703 filed on Sep. 30, 2015 and titled "MILLING WELLBORE CASING," which application is expressly incorporated herein by this reference in its entirety.

BACKGROUND

Downhole systems may be used to drill, service, or perform other operations on a wellbore in a surface location or a seabed for a variety of exploratory or extraction purposes. For example, a wellbore may be drilled to access valuable subterranean resources, such as liquid and gaseous hydrocarbons and solid minerals, stored in subterranean formations and to extract the resources from the formations.

In some wellbores, a casing may be installed to support the wellbore and to isolate the wellbore from fluids and material from the surrounding formation. In some wellbores, the casing may be removed in preparation for drilling of a lateral borehole from the wellbore, for slot recovery, or for abandonment purposes. In the case of wellbore abandonment, verifying the integrity of a cement plug in a well may be regulated by various jurisdictions to guard against environmental hazards. Such regulations may include verifying the integrity of the cement behind casing and, if the integrity is poor, sectioning of a certain length of casing and using a cement plug that directly contacts the surrounding formation. The casing may be removed by milling the casing from the surface of the wellbore and running a milling tool (e.g., a casing mill) downward through the wellbore. Portions of the casing may also be removed selectively at specific downhole locations by tripping a milling tool (e.g., a section mill) into the wellbore, expanding the section mill in place, and rotating and moving the milling tool axially to remove the desired amount of casing.

SUMMARY

In some embodiments, a cutting insert for a milling tool includes a body that defines or otherwise includes a back face, a cutting face, and a chip-breaking face. The back face is configured to be coupled to the milling tool, and the cutting face is opposite the back face. The chip-breaking face may define a face angle relative to the cutting face, and the face angle may be between 75° and 130°.

In other embodiments, a cutting insert includes a body formed of an ultrahard material. The body includes a back face and a cut-out portion. The cut-out portion defines a cutting face opposing the back face, and a chip-breaking face and a transition face. At least a portion of the chip-breaking face may be at an angle that is between 75° and 130° relative to at least a portion of the cutting face. The transition face is between the chip-breaking face and the cutting face, and collectively defines a continuous profile with the cutting face and the chip-breaking face.

In still other embodiments, a cutting insert includes a body that includes an ultrahard material. The body includes a back face and a cut-out portion. The cut-out portion defines a cutting face, a chip-breaking face, and a transition face defining a continuous partial elliptical or circular profile.

In yet other embodiments, a milling tool includes a mill body that can be rotated within a wellbore. Blades are coupled to the mill body, and may either be selectively fixed to extend radially outwardly from the mill body. Cutting inserts are coupled to the blades, and at least one of the cutting inserts includes a cutting insert body formed of an ultrahard material. The cutting insert body also includes a cutting face, a chip-breaking face, and a back face. The cutting face has a cutting edge and is oriented toward a direction of rotation of the blades. The chip-breaking face may be at least partially oriented at between a 75° and 130° angle relative to at least a portion of the cutting face. The back face is opposite the opposing the cutting face is coupled to a blade in a manner that positions the cutting face generally toward a direction of rotation of the mill body, and such that the chip-breaking face is oriented toward a downhole end portion of the mill body.

Example methods may also be used to form or use cutting inserts or milling tools of the present disclosure. For instance, a cutting insert according to any of various embodiments of the present disclosure can be formed at least partially out of an ultrahard material and coupled to a blade of a milling tool. Forming the cutting insert may include machining a block or body to cut-out a portion of the material and form a cutting face, a chip-breaking face, a transition face, or some combination thereof. Forming the cutting insert may further include using a mold or form to positively form a cut-out including the cutting face, chip-breaking face, or transition face, and avoiding machining or a similar operation.

In use, a section mill can be tripped into a wellbore. The section mill can include blades having cutting inserts coupled thereto. A cutting insert coupled to the blades may include a cutting face, transition face, and chip-breaking face defined by a continuous elliptical or circular profile. The section mill can be selectively activated to activate at least one blade and expand the blade radially to engage casing of the wellbore. The section mill can be rotated within the wellbore. Weight or a pull force can be applied to also move the section mill axially in the cased wellbore. Rotation and axial movement of the section mill can cause the cutting insert to mill an axial section of wellbore casing within the wellbore.

Additional features of embodiments of the disclosure will be set forth in the description and drawings, and in part will be obvious from the description, or may be learned by the practice of such embodiments. This summary is provided merely to introduce a selection of concepts that are further described in the detailed description. This summary is not intended to identify key or essential features of the claimed subject matter, nor is it intended to be used as an aid in limiting the scope of the claimed subject matter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a side cross-sectional view of a cutting insert positioned for cutting a workpiece, according to one or more embodiments of the present disclosure;

FIG. 3-2 is a side cross-sectional view of the cutting insert of FIG. 3-1 removing material from the workpiece and breaking the workpiece into chips, according to one or more embodiments of the present disclosure;

FIG. 8-1 is a side cross-sectional view of a cutting insert having a cutting face that is elliptical, according to one or more embodiments of the present disclosure;

FIG. 8-2 is a side cross-sectional view of a cutting insert having a cutting face that is elliptical, according to one or more embodiments of the present disclosure;

FIG. 9-1 is a side cross-sectional view of a cutting insert positioned for cutting a workpiece at a neutral rake angle, according to one or more embodiments of the present disclosure;

FIG. 9-2 is a side cross-sectional view of the cutting insert of FIG. 9-1 positioned for cutting a workpiece at a negative rake angle, according to one or more embodiments of the present disclosure;

FIG. 9-3 is a side cross-sectional view of the cutting insert of FIG. 9-1 positioned for cutting a workpiece at a positive rake angle, according to one or more embodiments of the present disclosure;

FIG. 11-1 is an axial cutaway view of a section mill having one or more cutting inserts on each of a plurality of blades for cutting wellbore casing, according to one or more embodiments of the present disclosure;

FIG. 11-2 is cross-sectional view of the section mill of FIG. 11-1 while milling a wellbore casing and forming chips of wellbore casing material, according to one or more embodiments of the present disclosure.

DETAILED DESCRIPTION

Figure 1:
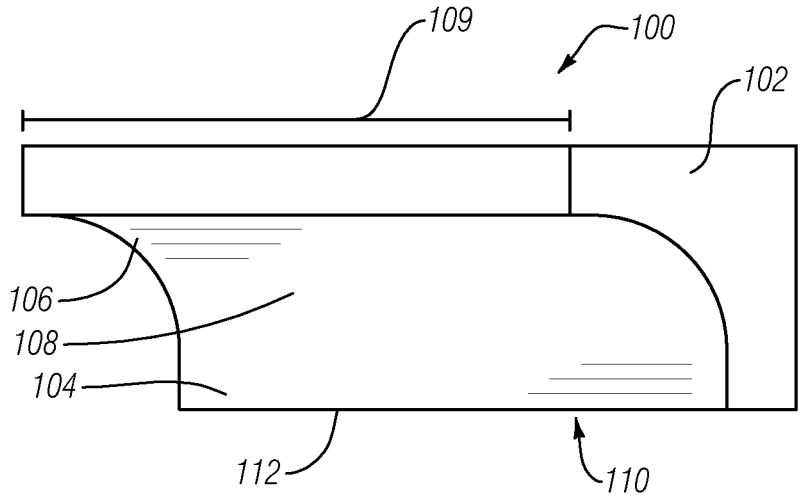
FIG. 1 is a perspective view of a cutting insert, according to one or more embodiments of the present disclosure.

Some embodiments of the present disclosure generally relate to devices, systems, and methods for milling or otherwise cutting metal. More particularly, some embodiments of this disclosure generally relate to cutting elements, such as cutting inserts that may be used to cut metallic wellbore casing in a downhole environment. A cutting element may include a cutting insert having a leading face. In some embodiments, the leading face may include a cutting face and a chip-breaking face. One or more transition faces may also be between the cutting face and the chip-breaking face and part of the leading face.

In some embodiments, the chip-breaking face may be oriented at an angle relative to the cutting face and potentially positioned uphole of the cutting face. The cutting face and chip-breaking face may cooperate to remove material from a wellbore casing and manage swarf generated during cutting for reliably creating swarf that is smaller than certain conventional cutting inserts, which may provide longer milling runs, improved operational lifetime, or both, for a cutting insert or milling tool. For instance, swarf cut by the cutting face may move upwardly toward the chip-breaking face (and potentially toward an uphole end portion of a milling tool). When contacting the chip-breaking face, the swarf can be deformed or forces can be applied to the swarf to cause it to break free of the wellbore casing. As used herein in relation to swarf, "small" or "smaller" should be understood to refer to swarf (sometimes referred to herein as "chips") that are, in some embodiments, less than 3 times a length of the leading face of the cutting insert. The length of the leading face may be a distance to travel along the cutting face, the chip-breaking face, and any transition face between the cutting face and the chip-breaking face. In other words, the length of the leading face may be the distance swarf could potentially travel if traversing along the full leading face. In other embodiments, the swarf may be less than 2 times the length of the leading face of the cutting insert. In yet other embodiments, the swarf may be less than 1.5 times the length of the leading insert. As used herein in relation to swarf, "long" or "longer" should be understood to refer to swarf or ribbons thereof that are more than 3 times the length of the leading face of the cutting insert. In some conventional cutting insert embodiments, a ribbon of swarf may be greater than 5 times, 10 times, or even 20 times, the length of the leading face of the cutting insert.

In some embodiments, the cutting insert may include a cutting face and chip-breaking face with a transition therebetween. The transition may, in some embodiments, be a transitional face. The transitional face may provide structural support for the cutting insert during operation. The transitional face may guide the swarf from the cutting face to the chip-breaking face. The swarf may contact the chip-breaking face and, upon being urged against the chip-breaking face by the continued cutting of the cutting face, the swarf may periodically break and form a plurality of chips instead of a longer ribbon of swarf.

Figure 2:
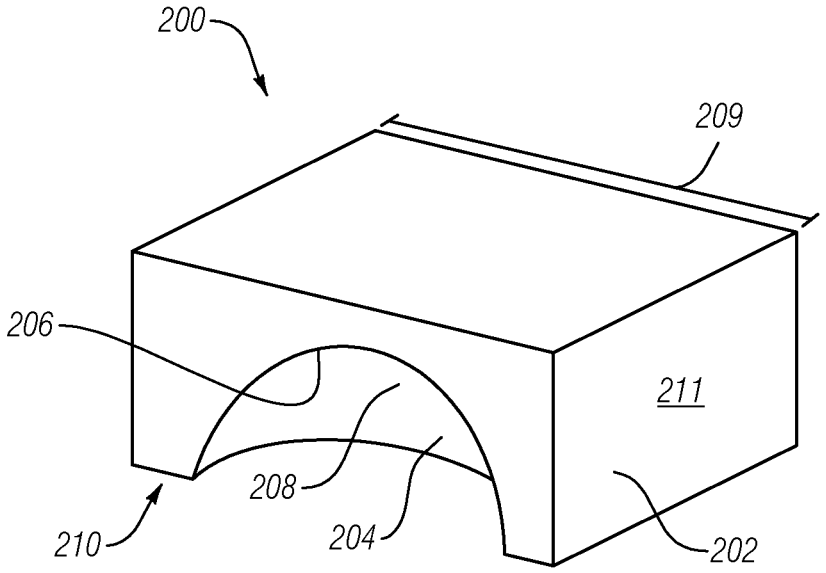
FIG. 2 is a perspective view of another cutting insert, according to one or more embodiments of the present disclosure.

FIGS. 1 and 2 illustrate example cutting inserts 100, 200, respectively, according to some embodiments of the present disclosure. In some embodiments, the cutting insert 100, as shown in FIG. 1, may have a monolithic body 102. The body 102 may be made of a single ultrahard material or may have one or more ultrahard materials therein (e.g., embedded in a host material). For example, the body 102 may include or be made of tungsten carbide (including cemented tungsten carbide), tungsten carbide doped with titanium carbide, tantalum carbide, niobium carbide, silicon carbide, alumina, cubic boron nitride, polycrystalline diamond, boron carbide, boron carbon nitride, materials having a hardness greater than 80 HRa (Rockwell Hardness A), or combinations of the foregoing. The material of the cutting insert 100 may be doped or undoped. In some embodiments, the cutting insert 100 may have a body 102 made of or including a metal alloy, including steels, such as carbon steel (e.g., AISI 10XX, AISI 11XX, AISI 12XX, or AISI 15XX), manganese steel (e.g., AISI 13XX), nickel steel (e.g., AISI 23XX or AISI 25XX), nickel-chromium steel (e.g., AISI 31XX, AISI 32XX, AISI 33XX, or AISI 34XX), molybdenum steel (e.g., AISI 40XX, or AISI 44XX), chromium-molybdenum steel (e.g., AISI 41XX), nickel-chromium-molybdenum steel (e.g., AISI 43XX or AISI 47XX), nickel-molybdenum steel (e.g., AISI 46XX or AISI 48XX), chromium steel (e.g., AISI 50XX or AISI 51XX), where "XX" may range from 1 to 99 and represents the carbon content, titanium alloys; nickel superalloys; other metal high melting temperature alloys; and the like; or combinations of the foregoing.

In some embodiments, the body 102 may have or define a cutting face 104 and a chip-breaking face 106. The cutting face 104 may be configured to cut into and remove material from a wellbore casing or other workpiece. Swarf generated by the cutting face 104 may be urged toward the chip-breaking face 106. The cutting insert 100 may include in a transition face 108 between the cutting face 104 and the chip-breaking face 106. In some embodiments, the transition face 108 may form a continuous curve with the cutting face 104 and the chip-breaking face 106. As used herein, "continuous" should be understood to mean the surface has a gradual change of slope and is free of abrupt angles. In other embodiments, the transition face 108 may be otherwise shaped relative to the cutting face 104 or the chip-breaking face 106. For example, a transition face 108 may be discontinuous. As used herein, "discontinuous" should be understood to mean the surface includes one or more abrupt angles therein that interrupt the continuity of the surface and abruptly change angles. In some embodiments, the transition face 108 may be omitted. For instance, a transition edge or point may be formed where an abrupt, discontinuous transition occurs between the cutting face 104 and the chip-breaking face 106. The length of a travel path from the start of the cutting face 104 to the end of the chip-breaking face 106 may be considered the length of the leading face of the cutting insert 100.

Swarf generated during cutting of a workpiece may be urged to move along the cutting face 104, toward and along the transition face 108, and to the chip-breaking face 106, which may facilitate breaking the swarf into individual chips. The individual chips of swarf, in contrast to the longer ribbons of swarf that can form entwined balls of swarf known as bird's nests, may enable longer operational lifetimes of the cutting insert 100 and potentially a corresponding milling tool to which the cutting insert 100 is operably coupled. The small swarf generated by a cutting insert according to some embodiments of the present disclosure may be flushed away from the cutting face of the milling tool more efficiently than the longer ribbons or bird's nests generated by conventional cutting inserts. The more efficient clearance of the swarf may reduce complications during milling, provide more consistent fluid flow through or around the milling tool, and increase the reliability of selective actuation and deactivation of blades of the milling. The more efficient clearance of swarf and flow of fluid may allow longer continuous milling runs, milling runs with less wear on the milling tool, or milling runs with reduced likelihood of losing the milling tool downhole.

The body 102 may have a contact face 110 adjacent to and at angle relative to the cutting face 104. The contact face 110 and the cutting face 104 may be joined along a cutting edge 112. The cutting edge 112 may form a substantially abrupt, discontinuous transition or junction between the contact face 110 and the cutting face 104, and may be used to cut into the wellbore casing or other workpiece. The cutting edge 112 may allow the cutting face 104 to also cut into the wellbore casing while the contact face 110 is substantially aligned with or in contact with the wellbore casing.

It should be understood that while the cutting insert 100 of FIG. 1 is shown with a uniform profile across a full length 109 of the cutting insert 100, in other embodiments, a cutting insert may have a variable or non-uniform profile across the length. For example, a cutting insert 200 of FIG. 2 may have one or more of a cutting face 204, a chip-breaking face 206, or a transition face 208 that extend partially along a length 209 of the cutting insert 200. For instance, in this embodiment, the cutting face 204, chip-breaking face 206, and transition face 208 may be formed within a cut-out formed in an otherwise generally rectangular cutting insert 200. Although described as a cut-out, the cut-out may not be formed by removing material, but may instead be formed by casting or otherwise forming the cutting insert 200 using a mold defining the cut-out.

In some embodiments, the cutting face 204, chip-breaking face 206, transition face 208, or combinations thereof, may be curved in a transverse direction. In other words, the cutting insert 200 may have a cutting face 204, a chip-breaking face 206, a transition face 208, or combinations thereof that are curved when viewed from a transverse end surface 211, or in a cross-sectional view along a plane parallel to the transverse end surface 211 or perpendicular to the contact face 210 (see FIGS. 3-1 to 3-3). A curve in a transverse direction may also be curved in a direction perpendicular to the direction the cutting insert 200 moves during cutting such as described in relation to FIGS. 3-1 and 3-2. In some embodiments, the cutting insert 200 may have a concavely curved cutting face 204, transition face 208 (i.e., a cut-out that curved inward in the body 202), or both. A concavely curved cutting face 204 may, in some embodiments, cut material and direct the swarf toward a transverse center of the length 209 of the cutting insert 200. In other embodiments, the cutting insert 200 may have a chip-breaking face 206 that is curved in the transverse direction. The shape of the cut-out may, in some embodiments, be generally defined by a three-dimensional shape having a constant profile, although in other embodiments, the profile may be varied across the length 109 of the three-dimensional shape (see FIG. 2).

As shown in FIG. 2, the cutting face 204, chip-breaking face 206, and transition face 208 may, in some embodiments, all be concave. In such embodiments, the cutting face 204, chip-breaking face 206, and transition face 208 may form a portion of a three-dimensional ellipsoid (having an elliptical profile) or sphere (having a spherical profile). For example, the cutting face 204, chip-breaking face 206, and transition face 208 may be formed by cutting into the body 202 of the cutting insert 200 using a rotating ellipsoid or sphere to remove material from the body 202 to form the cutting face 204, chip-breaking face 206, and transition face 208. In other embodiments, a mold having a partial ellipsoid or sphere may be used when forming the cutting insert 200. In some embodiments, the cutting face 204, chip-breaking face 206, and transition face 208 may have concave regions (e.g., spherical, ellipsoid, etc.) at or toward the transverse ends 211 with a central region having a uniform profile such as that shown in FIG. 1, or a central region may be concave with more uniform profiles toward the transverse ends 211. The cutting face 204, chip breaking face 206, and transition face 208 may be also formed with other curvatures, such as combinations of spherical and elliptical curvatures, or other combinations. In some embodiments, a spherical or elliptical cut-out forming the cutting face 204, the transition face 208, or both may be used to direct swarf in any combination of an upward direction (e.g., toward the chip-breaking face 206), a lateral direction (e.g., toward a center of the body 202 between transverse end faces 211), or a travel direction (e.g., parallel to the direction the cutting insert 200 travels as shown in FIGS. 3-1 and 3-2).

Figures 1, 3:
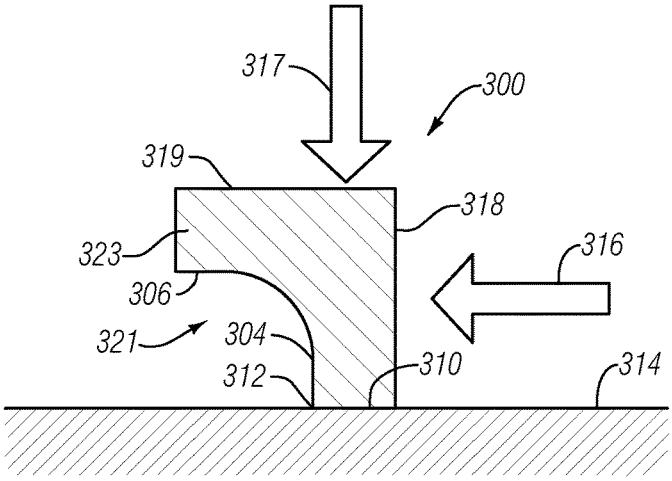
Figures 2, 3:
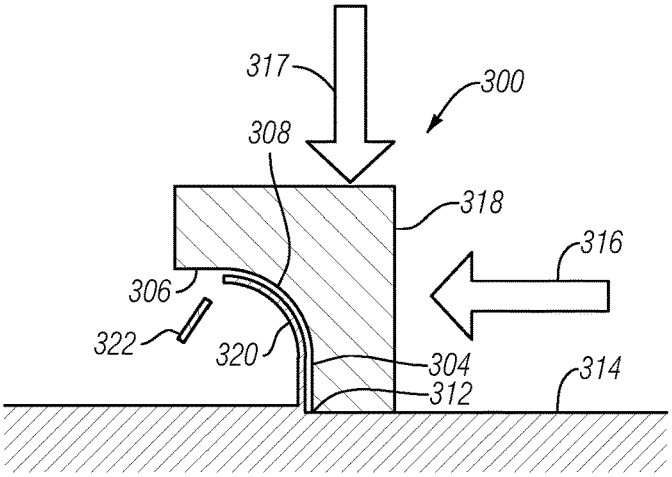

At least one embodiment of the cutting process is depicted in FIGS. 3-1 and 3-2. While FIGS. 3-1 and 3-2 depict cutting using an embodiment of a cutting insert 300 similar to the cutting insert 100 described in relation to FIG. 1, other embodiments of cutting inserts, such as those described in relation to FIG. 2 and FIGS. 4 through 10 may be used in a similar cutting process.

FIG. 3-1 is a cross-section of an embodiment of a cutting insert 300 (e.g., through a transverse center along a length of the cutting insert 300) positioned adjacent a workpiece such as wellbore casing 314 in preparation for cutting into and removing material from the wellbore casing 314. The cutting insert 300 may be positioned adjacent the wellbore casing 314 with at least the cutting edge 312 in contact with the wellbore casing 314. In some embodiments, the contact face 310 may be fully or partially in contact with the wellbore casing 314. In yet other embodiments, the cutting edge 312 may be in contact with the wellbore casing 314 and the contact face 310 may be oriented toward, but not in contact with, the wellbore casing 314.

A force 316 may be applied to the cutting insert 300 (e.g., to or perpendicular to the back face 318 of the cutting insert 300) to move the cutting insert 300 in a travel direction along and relative to the wellbore casing 314. In some embodiments, the force 316 may be applied by a cutting arm or a milling blade of a milling tool or by another motive source. For example, the cutting insert 300 may be mounted to a milling tool, and the milling tool may be rotated. The rotation of the milling tool may provide the force 316 used to move the milling tool and the cutting insert 300 around a circumference of the wellbore casing 314. The travel direction may therefore be a rotational direction. In other embodiments, an axial force may be used rather than a rotational force or torque to move in an axial travel direction to cut the wellbore casing 314.

In some embodiments, an additional force (e.g., force 317) may be applied to maintain the cutting insert 300 (and potentially a corresponding milling tool) in contact with the wellbore casing 314. The cutting insert 300 may be coupled to an expandable or fixed blade and the blade may apply the force 317 to a top face 319 of the cutting insert 300, or in a direction perpendicular to the top face 319. In some embodiments, the force 317 may be applied directly or indirectly to the cutting insert 300 in a direction perpendicular to the force 316, which may or may not also be perpendicular to the surface of the wellbore casing 314. For instance, the force 317 may be applied as weight on the milling tool, which tends to move the milling tool in a downhole direction. Thus, in such an embodiment, a chip-breaking face 306 of the cutting insert 300 may be oriented to face toward a downhole direction and corresponding downhole end portion of a body or other component of the milling tool. Similarly, the cutting face 304 may, in the profile view shown in FIG. 3-1, therefore extend axially in a direction parallel to the direction of the force 317 (which is optionally parallel to the longitudinal axis of the milling tool, the wellbore, or both).

In some embodiments, an upwardly directed pull force may be applied (e.g., to mill in an upward direction) and the force 317 may move the milling tool and the cutting insert 300 in an upward direction. According to at least some embodiments, the force 317 may be applied to a blade or other component of a milling tool, and such blade may then cause the force to be applied to the cutting insert 300. In some examples, the milling tool may include an expandable section mill, a lead mill, or a casing mill. In yet other examples, the cutting insert 300 may be coupled to a milling blade of a junk mill or other tool. For instance, the cutting insert 300 may be fixed at a rotational position, an axial position, or both a rotational and axial position on a blade of a mill or other tool. The cutting inserts can be also used on other downhole tools such as through-tubing mills, casing scrapers, dress mills, follow mills, watermelon mills, and the like, and for various types of downhole operations (e.g., sidetracking).

As also shown in FIG. 3-1, the top face 319 may be offset from the chip-breaking face 306. For instance, the height of the cutting insert 300 may be defined between the contact face 310 and the top face 319. A cut-out 321 or other feature forming or defining the cutting face 304 and the chip-breaking face 306 may extend a partial height of the cutting insert 300, thereby defining a lip 323 above the chip-breaking face 306 and the cut-out 321. In some embodiments, when the cutting insert 300 is coupled to a milling tool, the lip 323 may remain above or uphole of the cut-out 321 and the wellbore casing 314 or other workpiece.

The body of the cutting insert 300 is shown as including a single cut-out 321. In some embodiments, a percentage of the height of the cut-out 321 relative to the height of the cutting insert 300 may be within a range including a lower limit, an upper limit, or both lower and upper limits including any of 10%, 20%, 30%, 50%, 55%, 60%, 65%, 70%, 75%, 80%, 85%, 90%, 100%, or values therebetween. For instance, the height of the cut-out 321 may be between 25% and 85%, between 50% and 80%, between 60% and 65%, or between 75% and 80% of the height of the cutting insert 300. In other embodiments, the height of the cut-out 321 may be less than 10% of the height of the cutting insert 300. Additionally, while FIG. 3-1 shows a single cut-out 321 in the body of the cutting insert 300, in other embodiments, there may be multiple cut-outs 321. For instance, multiple cut-outs may be stacked along the height of the cutting insert.

Referring now to FIG. 3-2, the movement of the cutting insert 300 relative to the wellbore casing 314 (and any force applied to maintain the cutting insert 300 in contact with the casing 314) may cause the cutting edge 312 to cut the wellbore casing 314 and form swarf 320. The swarf 320 may be urged along the cutting face 304 (upward in FIG. 3-2), and along the transition face 308 and toward the chip-breaking face 306 (upward and to the left in FIG. 3-2). The angle of the chip-breaking face 306, the transition face 308, or both may be used to bend and deform the swarf 320 to break the swarf 320 into a series of chips 322. The chips 322 may be removed from the cutting area more readily than a longer ribbon of swarf, which may increase the rate at which the wellbore casing 314 is cut and the reliability of the milling tool used to cut the wellbore casing 314.

The wellbore casing 314 may be made of or include a metal, metal alloy, other materials, or combinations of the foregoing. The material of the wellbore casing 314 may therefore be at least somewhat malleable and may work harden during cutting. When work hardened, the metallic microstructure may be plastically deformed and accumulate dislocations in the metal, thereby increasing strain in the metal. Plastic deformation of the metal will strain the metallic bonds and move the microstructure from a more stable, lower energy state, to a less stable, higher energy state, and the microstructure will be more brittle. The less stable, higher energy state reduces the ductility of the metal and allows the metal to break more easily. Work hardening of the swarf 320 may occur during metal cutting as the cutting insert 300 applies a high shear stress in the cutting process. When the swarf 320 passes from the cutting face 304 to the chip breaking face 306, the swarf 320 is further bent and deformed by the curvature or other transition, leading to the work hardened swarf 320 breaking into small chips 322.

Figure 6:
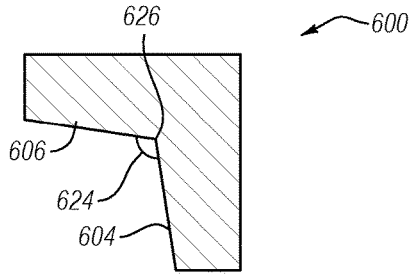
FIG. 6 is a side cross-sectional view of a cutting insert having an abrupt corner at a transition between a cutting face and a chip-breaking face, according to one or more embodiments of the present disclosure.
Figure 7:
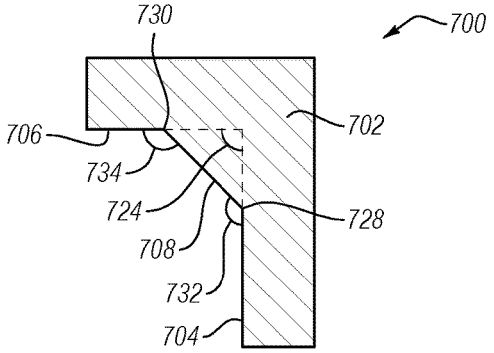
FIG. 7 is a side cross-sectional view of a cutting insert having a transition face that is linear in profile, according to one or more embodiments of the present disclosure.
Figures 1, 8:
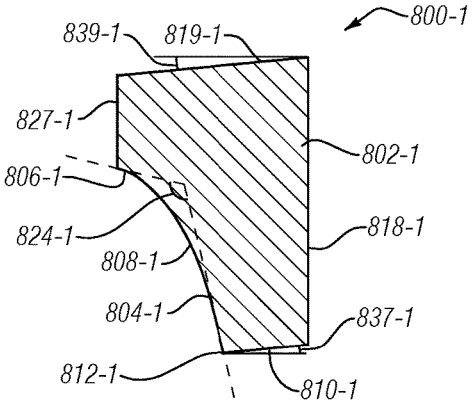
Figures 2, 8:
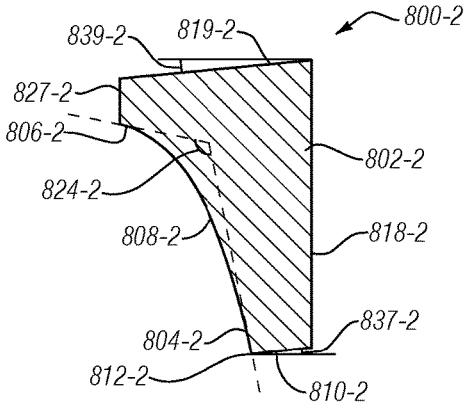

FIG. 4 through FIG. 8-1 are side cross-sectional views of different embodiments of cutting inserts having cutting faces and chip-breaking faces in various configurations. One or more features of the various cutting inserts described or illustrated herein (including in FIGS. 1 through 3-2) may be combined with one or more features of other cutting inserts described or illustrated herein. For example, the discontinuous transition between the cutting face and the transition face described in relation to the embodiment depicted in FIG. 7 may be combined with the a contact angle described in relation to the embodiment depicted in FIG. 4. In another example, the quarter-circular or other curved cutting face described in relation to the embodiment depicted in FIG. 4, or an elliptical cutting face described in relation to the embodiment depicted in FIGS. 8-1 and 8-2, may be combined with the discontinuous transition between a cutting face and a chip-breaking face described in relation to the embodiment depicted in FIG. 5. A relief angle at a contact face, a top face, or both, as shown in FIGS. 8-1 and 8-2 may further be used in combination with cutting faces have any suitable configuration. In still another example, the size, number, or arrangement of cut-outs described relative to FIG. 3-1 may also apply equally to other cutting inserts and cut-outs described herein.

Figure 4:
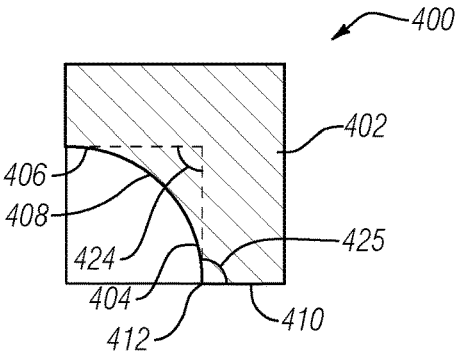
FIG. 4 is a side cross-sectional view of a cutting insert having a profile with a constant radius of curvature, according to one or more embodiments of the present disclosure.

FIG. 4 is a side cross-sectional view of a cutting insert 400. In some embodiments, the cutting insert 400 may be the same as or similar to the cutting insert 200 of FIG. 2. In this particular embodiment, the cross-section shows a substantially quarter-circular profile (i.e., a profile of a quadrant). The cutting insert 400 may have a cutting face 404, a chip-breaking face 406, and a transition face 408 that are substantially continuous, and form a substantially constant radius of curvature between the cutting face 404, the chip-breaking face 406, and the transition face 408. In other embodiments, the radius of curvature may be variable or discontinuous. In some embodiments, the cutting face 404, a chip-breaking face 406, and a transition face 408 may be formed by a spherical or elliptical cut-out in a body 402. In such embodiments, the cut-out may extend a full or partial length of the cutting insert 400, and the size of the cut-out may vary along the length of the cutting insert 400. In other embodiments, the size of the cut-out (and corresponding sizes, shapes, or other configurations of the cutting face 404, chip-breaking face 406, and transition face 408) may be constant along the length of the cut-out of the cutting insert 400.

The relative orientation of at least a portion of the cutting face 404 at or near the cutting edge 412 and at least a portion of the chip-breaking face 406 may form a face angle 424. In some embodiments, the face angle 424 may be within a range having a lower value, an upper value, or both upper and lower values including any of 60°, 75°, 90°, 105°, 120°, 130°, or any value therebetween. For example, the face angle 424 may be in a range of 75° to 130°. In another example, the face angle 424 may be in a range of 80° to 125°. In yet another example, the face angle 424 may be in a range of 90° to 120°. In a yet further example, the face angle 424 may be 90°. In still further embodiments, the face angle 424 may be less than 60° or greater than 130°. In some embodiments, the face angle 424 may be defined between lines tangent to the cutting face 404 and the chip-breaking face 406.

The chip-breaking face 406 may be oriented at the face angle 424 relative to the cutting face 404 to allow or facilitate swarf generated during milling or other cutting to move away from the workpiece being cut before breaking into chips. In some embodiments, a face angle 424 at or above 90° may allow or facilitate a more gradual deformation of the swarf before breaking into chips. In some embodiments, the cutting face 404 may be curved. Where curved, the radius of the curvature of the cutting face 404 to the chip-breaking face 406 of the cutting insert 400 may be in a range of 0.1 in. (2.5 mm) to 1.0 in. (25.4 mm) in some embodiments. A larger value of a face angle 424 (e.g., 90° or greater) may therefore, in some embodiments, facilitate consistent cutting and less consistent chip-formation. In some embodiments, a face angle 424 less than 90° may allow or facilitate a more aggressive deformation of swarf. A more aggressive deformation of swarf may cause the swarf to break into chips. A smaller face angle 424 may facilitate more consistent chip-formation and more force on the swarf from the cutting face 404, the cutting edge 412, or both the cutting face 404 and the cutting edge 412. In some embodiments, the face angle 424 may vary a long a length of the cutting insert 400.

The contact face 410 may be oriented at a contact angle 425 relative to the cutting face 404. In some embodiments, the contact angle 425 may correspond to or allow the cutting insert 400 to be positioned adjacent a wellbore casing or other workpiece at any particular rake angle, as will be described in greater detail hereafter. In other embodiments, the contact angle 425 may allow for additional clearance of the contact face 410 adjacent the wellbore casing to ensure or facilitate the cutting edge 412 remaining in contact with the wellbore casing as the contact face 410 may wear during cutting. For example, the cutting face 404 of the cutting insert 400 may be oriented 90° from a wellbore casing (similar to the embodiment shown in FIG. 3-1). The contact face 410 may form a contact angle 425 that is less than 90° such that the cutting edge 412 is an edge of the contact face 410 that initially touches, or remains in contact with, the wellbore casing. For instance, as the contact face 410 wears during operation, the contact face 410 may maintain contact of the cutting edge 412 with the wellbore casing. In some embodiments, the cutting edge 412 may move, such as when the contact face 410 or the cutting face 404 wears, and the junction between the contact face 410 and the cutting face 404 moves. In some embodiments, the contact angle 425 may be within a range having a lower value, an upper value, or both upper and lower values including any of 75°, 85°, 90°, 95°, 105°, 115°, 125°, 135°, 145° or any value therebetween. For example, the contact angle 425 may be between 75° and 125° or between 80° and 100°. In another example, the contact angle 425 may be between 84° to 96°. In yet another example, the contact angle 425 may be 90°. In still other embodiments, the contact angle 425 may be less than 75° or greater than 145°.

Figure 5:
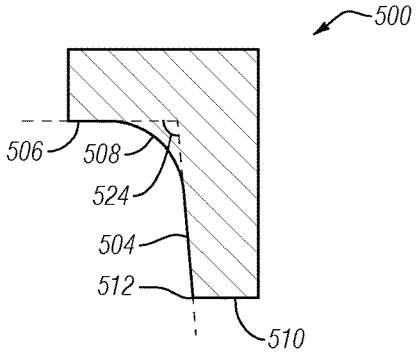
FIG. 5 is a side cross-sectional view of a cutting insert having a cutting face that is at least partially linear in profile, according to one or more embodiments of the present disclosure.

FIG. 5 is a side cross-sectional view depicting a profile of an example cutting insert 500, according to some embodiments of the present disclosure. In the illustrated embodiment, the cutting insert 500 is shown as having a substantially linear cutting face 504. As used herein, "substantially linear" should be understood to refer to a cutting face 504 having at least a portion of the cutting face 504 that is not curved when viewed in a profile view (i.e., through a cross-section perpendicular to the cutting direction of the cutting insert 500). For example, at least a portion of the cutting face 504 may be planar when viewed in profile. The cutting face 504 may be adjacent a contact face 510 with a cutting edge 512 at the junction therebetween. The cutting insert 500 may include a chip-breaking face 506, at least a portion of which may form a face angle 524 with the cutting face 504, which may be substantially linear in some embodiments. A transition face 508 may extend between the cutting face 504 and the chip-breaking face 506, and optionally forms a continuous profile therebetween. In some embodiments, the cutting face 504 may be perpendicular to the chip-breaking face 506. In other embodiments, such as the depicted embodiment of the cutting insert 500 in FIG. 5, the cutting face 504 may be oriented at an obtuse angle relative to the chip-breaking face 506. In yet other embodiments, the cutting face 504 may be oriented at an acute angle to the chip-breaking face 506.

FIG. 6 is a side view of another embodiment of a cutting insert 600 according to some embodiments of the present disclosure. The cutting insert 600 may include a cutting face 604 and a chip-breaking face 606. In some embodiments, the cutting face 604, the chip-breaking face 606, or both, may be substantially linear in profile. In other embodiments, at least a portion of the cutting face 604, the chip-breaking face 606, or both, may be curved in profile. The cutting insert 600 may lack a transition face between the cutting face 604 and the chip-breaking face 606. For example, a profile view of the cutting insert 600 may show a discontinuity, such as face corner 626, which abruptly transitions between the cutting face 604 and the chip-breaking face 606. In some embodiments, a face angle 624 at the face corner 626 between the cutting face 604 and the chip-breaking face 606 may be obtuse, as depicted in FIG. 6. In other embodiments, the face angle 624 may be an acute angle or a right angle.

In some embodiments, stresses of the cutting insert 600 may be concentrated at or near the face corner 626, which may weaken the cutting insert 600. A cutting insert may therefore be formed to distribute the stresses, such as by having a plurality of face corners or having a continuous profile. Referring now to FIG. 7, another embodiment of a cutting insert 700 shows an example embodiment in which a transition face 708 is formed between a cutting face 704 and a chip-breaking face 706. In the illustrated embodiment, the cutting face 704 and chip-breaking face 706 may each meet the transition face 708 at a discontinuous or abrupt cutting face corner 728 and a discontinuous or abrupt chip-breaking face corner 730, respectively. The transition face 708 may provide additional strength to the body 702 of the cutting insert 700 by distributing stresses over multiple corners and thickening the body 702 as compared to the embodiment shown in FIG. 6. In some embodiments, however, the cutting insert 600 of FIG. 6 may be desired (e.g., for obtaining chips of a desired size).

Referring again to FIG. 7, in some embodiments, a cutting face transition angle 732 may be formed or defined between the cutting face 704 and the transition face 708, and a chip-breaking face transition angle 734 may be formed or defined between the transition face 708 and the chip-breaking face 706. In some embodiments, the cutting face transition angle 732 and the chip-breaking face transition angle 734 may be equal. In other embodiments, the cutting face transition angle 732 and the chip-breaking face transition angle 734 may not be equal. For example, the cutting face transition angle 732 may be greater than the chip-breaking face transition angle 734. In another example, the cutting face transition angle 732 may be less than the chip-breaking face transition angle 734.

In some embodiments, the cutting face transition angle 732 and chip-breaking face transition angle 734 may, together, define a face angle 724 between the cutting face 704 and the chip-breaking face 706. For example, the cutting face transition angle 732 and the chip-breaking face transition angle 734 may be supplemental angles and have a sum equaling the face angle 724. In other embodiments, however, the cutting face transition angle 732 and the chip-breaking face transition angle 734 may not have a sum equal to the face angle 724. For instance, where the cutting face 704 or the chip-breaking face 706 is curved in the profile view, different tangent or other reference lines may be used when defining the face angle 724 as compared to the cutting face transition angle 732 and the chip-breaking face transition angle 734. In some embodiments, the reference line may be defined as an average position (e.g., an undulating line or line with a combination of straight and curbed sections).

In some embodiments, the cutting face transition angle 732 and the chip-breaking face transition angle 734 may each be within a range having a lower value, an upper value, or both upper and lower values including any of 100°, 120°, 135°, 150°, 170°, or any value therebetween. For example, the cutting face transition angle 732, the chip-breaking face transition angle 734, or both may be between 100° and 170°. In another example, the cutting face transition angle 732 or the chip-breaking face transition angle 734 may be between 110° and 160°. In yet another example, the cutting face transition angle 732 or the chip-breaking face transition angle 734 may be between 120° and 150°. In at least one example, the cutting face transition angle 732 and the chip-breaking face transition angle 734 may each be 135°. In still another embodiment, the cutting face transition angle 732 or the chip-breaking face transition angle 734 may be less than 100° or greater than 170°.

While embodiments are described herein having a cutting face, a chip-breaking face, a transition face, and combinations thereof that are curved in profile and linear in profile, it should be understood that any of the cutting face, chip-breaking face, and transition face may include portions that are curved in profile, portions that are linear in profile, or portions that are linear and portions that are curved in profile, according to the present disclosure. For example, a profile of the cutting face and chip-breaking face may include curved portions, which may be separated by a linear transition face or another curved portion. Such other curved portion may have a different radius of curvature, a different direction of curvature, a different type of curvature (e.g., circular, elliptical, undulating, etc.), or combinations of the foregoing. In another example, the cutting face and transition face may include curved portions, and the chip-breaking face may be substantially linear. In yet another example, one or more faces may include curved portions that meet at a discontinuous, abrupt corner.

FIGS. 8-1 and 8-2 are side cross-sectional views of cutting inserts 800-1, 800-2 (collectively cutting inserts 800). In some embodiments, the cutting inserts 800 may be the same as or similar to the cutting insert 100 of FIG. 1. In these particular embodiments, the cross-sections show substantially continuous, elliptical profile. The cutting inserts 800-1, for instance, may have a cutting face 804-1, a chip-breaking face 806-1, and a transition face 808-1 that are substantially continuous, and form a substantially continuous, elliptical curvature profile. The size of the cutting elliptical profile may vary. For instance, FIG. 8-2 also shows a substantially continuous, elliptical cutting profile that includes a cutting face 804-2, a chip-breaking face 806-2, and a transition face 808-2. In FIG. 8-2, however, the elliptical profile is larger, such that the body 802-2 has less material than the body 802-1 (assuming both have the same width). In such an embodiment, the thickness of the cutting insert 800-2 adjacent the contact face 810-2 (i.e., between the cutting face 804-2 and the back face 818-2) may be less than the thickness of the cutting insert 800-1 adjacent the contact face 810-1 (i.e., between the cutting face 804-1 and the back face 818-1). In the same or other embodiments, the thickness of the cutting insert 800-2 may similarly be less adjacent the chip-breaking face 806-2 (e.g., at a lip between the chip-breaking face 806-2 and the top face 819-2) than the thickness of the cutting insert 800-1 adjacent the chip-breaking face 806-1 (i.e., at a lip between the chip-breaking face 806-1 and the top face 819-1). Of course, such embodiments are merely illustrative, and the size, orientation, or other configuration of an elliptical or partially elliptical curvature profile may be varied based on a number of factors, such as the desired thickness of the insert body, the size of the cutting insert, the desired shape of swarf cut by the cutting face, and the like. Although the cut-out is shown as creating a profile extending a partial height (e.g., from cutting edge 812-1, 812-2 to top face 819-1, 819-2) and a partial width (e.g., from front face 827-1, 827-2 to back face 818-1, 818-2), in some embodiments, the cut-out having a partial elliptical, partial circular, or other profile may extend a full height or width of the cutting insert 800-1, 800-2.

The relative orientation of at least a portion of the cutting face 804-1, 804-2 at or near the cutting edge 812-1, 812-2 and at least a portion of the chip-breaking face 806-1, 806-2 may form a face angle 824-1, 824-2. For instance, the face angles 824-1, 824-2 may be defined between a line tangent to the elliptical profile of the cutting face 804-1, 804-2 adjacent the contact face 810-1, 810-2, and a line tangent to the elliptical profile of the chip-breaking face 806-1, 806-2 adjacent a front face 827-1, 827-2. In some embodiments, the face angle 824-1, 824-2 may be within a range having a lower value, an upper value, or both upper and lower values including any of 50°, 75°, 90°, 105°, 110°, 115°, 120°, 125°, 130°, 145°, 160°, 175°, or any value therebetween. For example, the face angle 824-1, 824-2 may be in a range of 75° to 145°. In another example, the face angle 824-1, 824-2 may be in a range of 90° to 130°. In yet another example, the face angle 824-1, 824-2 may be in a range of 95° to 115° or 105° to 125°. In a yet further example, the face angle 824-1 may be 115° and the face angle 824-2 may be 105°. In still further embodiments, the face angle 824-1, 824-2 may be less than 50° or greater than 175°.

The chip-breaking faces 806-1, 806-2 may be oriented at the face angles 824-1, 824-2 relative to the cutting face 804-1, 804-2 to allow or facilitate swarf generated during milling or other cutting to move away from the workpiece being cut before breaking into chips. In some embodiments, a face angle 824-1, 824-2 at or above 90° may allow or facilitate a more gradual deformation of the swarf before breaking into chips, as discussed with respect to FIG. 4. In some embodiments, the elliptical portion of the cut-out may be generated by an elliptical profile having a major diameter between 0.5 in. (12.7 mm) and 3 in. (76.2 mm), and a minor diameter between 0.2 in. (5.1 mm) and 1.2 in. (30.5 mm). For instance, the major diameter may be between 0.8 in. (20.3 mm) and 1.2 in. (30.5 mm) and the minor diameter may be between 0.3 in. (7.6 mm) and 0.5 in. (12.7 mm). In some embodiments, the major diameter may be less than 0.5 in. (12.7 mm) or greater than 3 in. (76.2 mm). In some embodiments, the minor diameter may be less than 0.2 in. (5.1 mm) or greater than 1.2 in. (30.5 mm).

The contact face 810-1, 810-2 may be oriented at a contact angle relative to the cutting face 804-1, 804-2, as discussed herein. In some embodiments, the contact angle may correspond to or allow the cutting insert 800-1, 800-2 to be positioned adjacent a wellbore casing or other workpiece at any particular rake angle 837-1, 837-2, as will be described in greater detail hereafter with respect to FIGS. 9-1 to 9-3.

As further shown in FIGS. 8-1 and 8-2, the top face 819-1, 819-2 may, in some embodiments, not be perpendicular to the back face 818-1, 818-2, the front face 827-1, 827-1, or both. For instance, the top face 819-1, 819-2 may be oriented at a support angle 839-1, 839-2 relative to a line that is perpendicular to the back face 818-1, 818-2, the front face 827-1, 827-2 or parallel to the workpiece. Optionally, the top face 819-1, 819-2 may be parallel to the contact face 810-1, 810-2. In some embodiments, where multiple cutting inserts 800-1, 800-2 are aligned on a blade or other tool (e.g., blade 1038 of FIG. 10), similar relief and support angles may allow the contact face 810-1, 810-2 of a cutting insert 800 to potentially be in contact along its width with the top face 819-1, 819-2 of an adjacent cutting insert 800. In other embodiments, the support angle 839-1, 839-2 may be different than a corresponding relief angle 837-1, 837-2.

Figures 1, 9:
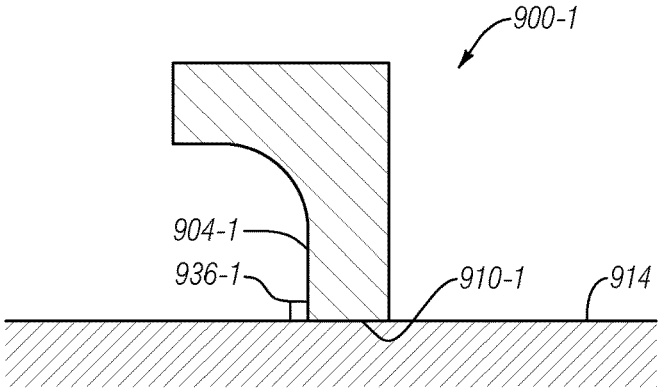
Figures 2, 9:
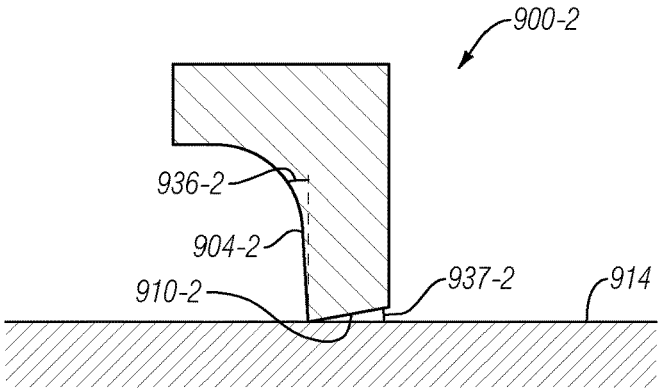
Figures 3, 9:
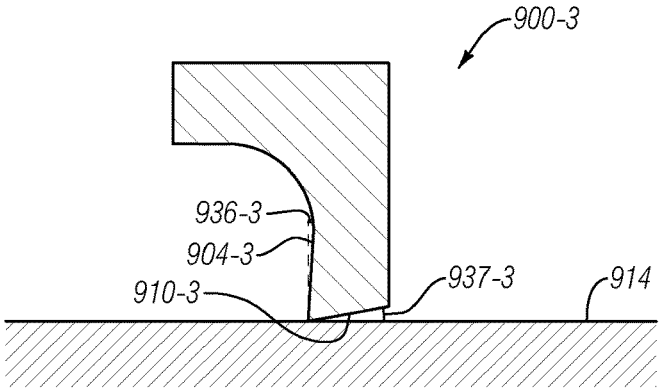

FIGS. 9-1 through FIG. 9-3 illustrate different example embodiments of cutting inserts 900-1 to 900-3 (collectively cutting inserts 900), with corresponding different orientations of contact faces 910-1 to 910-3 (collectively cutting faces 910) relative to corresponding cutting faces 904-1 to 904-3 (collectively cutting faces 904) or wellbore casing 914. FIG. 9-1 depicts the cutting insert 900-1 oriented relative to the wellbore casing 914, with the cutting face 904 at a neutral rake angle 936-1 relative to the wellbore casing 914. It should be understood that when referring to the rake angle 936-1, the rake angle 936-1 is measured between the cutting face 904-1 and a direction normal to the surface of the wellbore casing 914 being cut during milling. For example, the embodiment depicted in FIG. 9-1 shows the cutting face 904-1 oriented perpendicularly (i.e. normal) to the surface of the wellbore casing 914 to be cut. The rake angle 936-1 is therefore 0°, or neutral, relative to the direction normal to the surface of the wellbore casing 914. In some embodiments, the surface of the wellbore casing 914 or other workpiece being cut may be perpendicular to a longitudinal axis of a milling tool, a wellbore, or both. In some embodiments, the rake angle 936-1 may therefore be measured as an angle of the cutting face 904-1 relative to a direction parallel to the longitudinal axis of the milling tool (e.g., milling tool 1144 of FIG. 11-1 or milling tool 1251 of FIG. 12).

FIG. 9-2 depicts the cutting insert 900-2 oriented relative to the wellbore casing 914 with the cutting face 904-2 at a negative rake angle 936-2 relative to the wellbore casing 914. The cutting face 904-2 is, therefore, oriented at an acute angle relative to the downhole surface of the wellbore casing 914, or, in other words, oriented toward the cutting direction. A negative rake angle 936-2 may allow the cutting insert 900-2 to scrape material from the wellbore casing 914 and may reduce complications of the cutting face 904-2 catching on surface imperfections and inhibiting movement of the cutting insert 900-2 or corresponding milling tool to which the cutting insert 900-2 is attached, or it may reduce vibrations within the milling tool. In some embodiments with a negative rake angle 936-2, the rake angle 936-2 may be within a range having a lower value, an upper value, or both upper and lower values including any of −0.1°, −5.0°, −10.0°, −15.0°, −20.0°, −25.0°, or any value therebetween. For example, the rake angle 936-2 may be between −0.1° and −25.0. In another example, the rake angle 936-2 may be between −2.0° and −8.0°. In yet another example, the rake angle 936-2 may be between −4.0° and −6.0°. In still another embodiment, the rake angle 936-2 may be negative and may be less than −25.0° or greater than −0.1°.

FIG. 9-2 also illustrates the cutting insert 900-2 in contact with the wellbore casing 914 at a cutting edge, and with a relief angle 937-2 between the contact face 910-2 and the wellbore casing 914. In some embodiments, the relief angle 937-2 (or a support angle as described relative to FIGS. 8-1 and 8-2) may be within a range having a lower value, an upper value, or both upper and lower values including any of 0.1°, 2.5°, 5.0°, 7.5°, 10.0°, 20.0°, or any value therebetween. For example, the relief angle 937-2 may be between 0.1° and 20.0°. In another example, the relief angle 937-2 may be between 2.0° and 8.0°. In yet another example, the relief angle 937-2 may be between 4.0° and 6.0°. In still another embodiment, the relief angle 937-2 may be less than 0.1° or greater than 20.0°. The relief angle 937-2, the rake angle 936-2, or both, that is used may at least partially be determined based on the material of which the wellbore casing 914 (or other workpiece) is made, the rotational speed of a milling tool that includes the cutting insert 900-2, the desired cutting rate, the weight on the milling tool, or other factors.

FIG. 9-3 depicts the cutting insert 900-3 oriented relative to the wellbore casing 914 with the cutting face 904-3 at a positive rake angle 936-3 relative to the wellbore casing 914. The cutting face 904-3 is, therefore, oriented at an obtuse angle relative to the downhole surface of the wellbore casing 914, or, in other words, oriented away from the cutting direction. A positive rake angle 936-3 may allow the cutting insert 900-3 to gouge material from the wellbore casing 914 and may remove material from the wellbore casing 914 more aggressively and efficiently. In some embodiments with a positive rake angle 936-3, the rake angle 936-3 may be within a range having a lower value, an upper value, or both upper and lower values including any of 0.1°, 2.5°, 5.0°, 7.5°, 10.0°, 20.0°, or any value therebetween. For example, the rake angle 936-3 may be between 0.1° and 20.0°. In another example, the rake angle 936-3 may be between 2.0° and 8.0°. In yet another example, the rake angle 936-3 may be between 4.0° and 8.0°. In yet another example, the rake angle 936-3 may be less than 0.1° or greater than 20.0°. The rake angle 936-3 of the cutting insert 900-3 may be at least partially dependent on the material of which the wellbore casing 914 (or other workpiece) is made, the rotational speed of the corresponding milling tool, the milling rate, or other factors. In some embodiments, a relief angle 937-3 may also be used with a positive rake angle 936-3 or even a neutral rake angle (e.g., rake angle 936-1).

Figure 10:
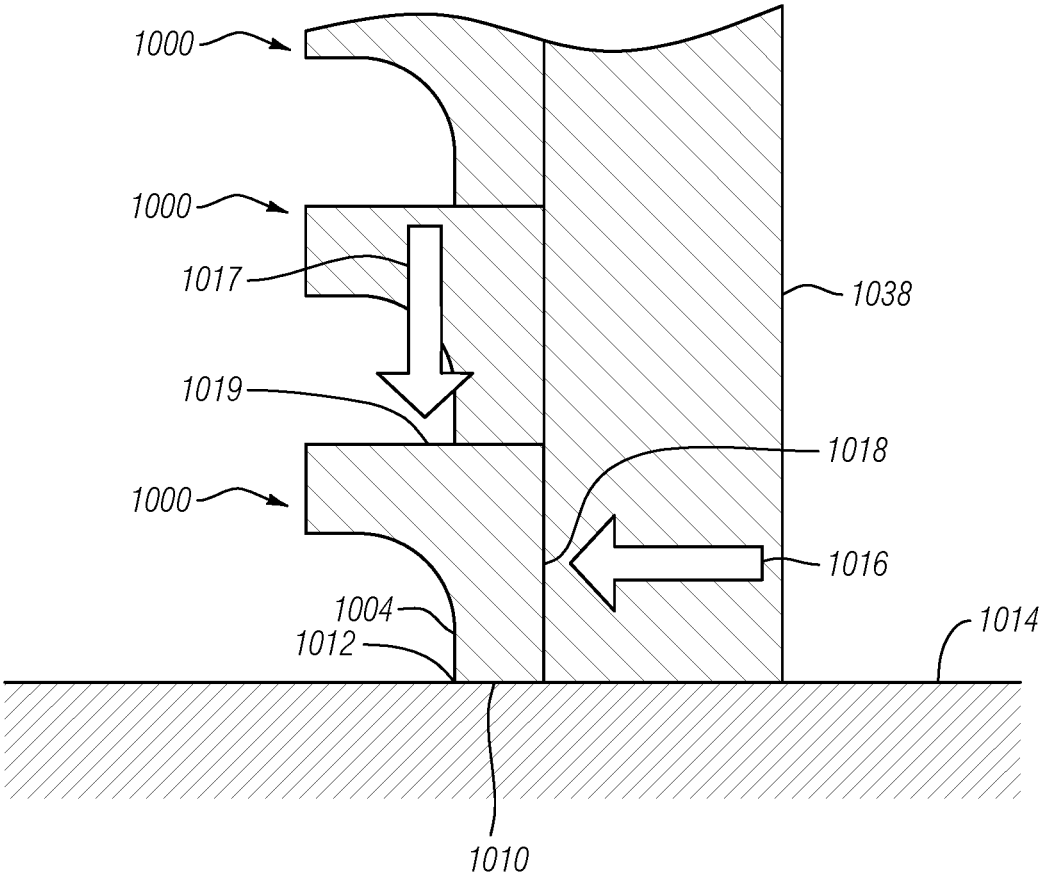
FIG. 10 is a side cross-sectional view of a milling tool with a cutting insert positioned for cutting a wellbore casing, according to one or more embodiments of the present disclosure.

FIG. 10 illustrates an embodiment of cutting inserts 1000 coupled to a blade 1038 of a milling tool. The milling tool may be a lead mill, a section mill, a casing mill, a junk mill, or another type of milling or cutting device. The blade 1038 may provide a motive force 1016 applied to a back face 1018 or other surface or component of the cutting inserts 1000, similar to as described in relation to FIGS. 3-1 and 3-2. The blade 1038 may further provide or transfer a force 1017 to compress a cutting edge 1012 or contact face 1010 of a cutting insert 1000 nearest the wellbore casing 1012 against or into the wellbore casing 1014. In some embodiments, the force 1017 may be applied to the top face 1019 of the cutting inserts 1000. In other embodiments, however, the force 1017 may be applied to the blade 1038 which may have the cutting inserts 1000 surface bonded or mounted (e.g., brazed, attached with mechanical fasteners, etc.) thereto. As the force 1017 is then applied to the blade 1038, the force 1017 may be transferred to the cutting inserts 1000 and the bonding, adhesion, or fastening mechanism may withstand a shear force and transfer the force 1017 to the cutting inserts 1000. In some embodiments, the force 1017 may be applied as downhole weight on a milling tool and the cutting insert 1000, or as a pull force on the milling tool and the cutting insert 1000.

The force 1017 may hold one or more cutting inserts 1000 in contact with the wellbore casing 1014 while the force 1016 (e.g., a rotational force of a milling tool relative to the wellbore casing 1014) urges the cutting inserts 1000 through the wellbore casing 1014, cutting material from the wellbore casing 1014 as described herein. In some embodiments, the force 1016 may be a torque applied by or to the milling tool. In an example embodiment, the torque may be in a range between 200 ft.-lbs. (271 N-m) and 3,000 ft.-lbs. (4,067 N-m). In some embodiments, multiple cutting inserts 1000 may be provided in a direction parallel to the force 1017. The additional cutting inserts 1000 may be redundant cutting inserts, such that as one cutting insert 1000 wears away, an adjacent cutting insert 1000 may be used as a redundant or back-up cutting element for milling the wellbore casing 1014.

Figures 1, 11:
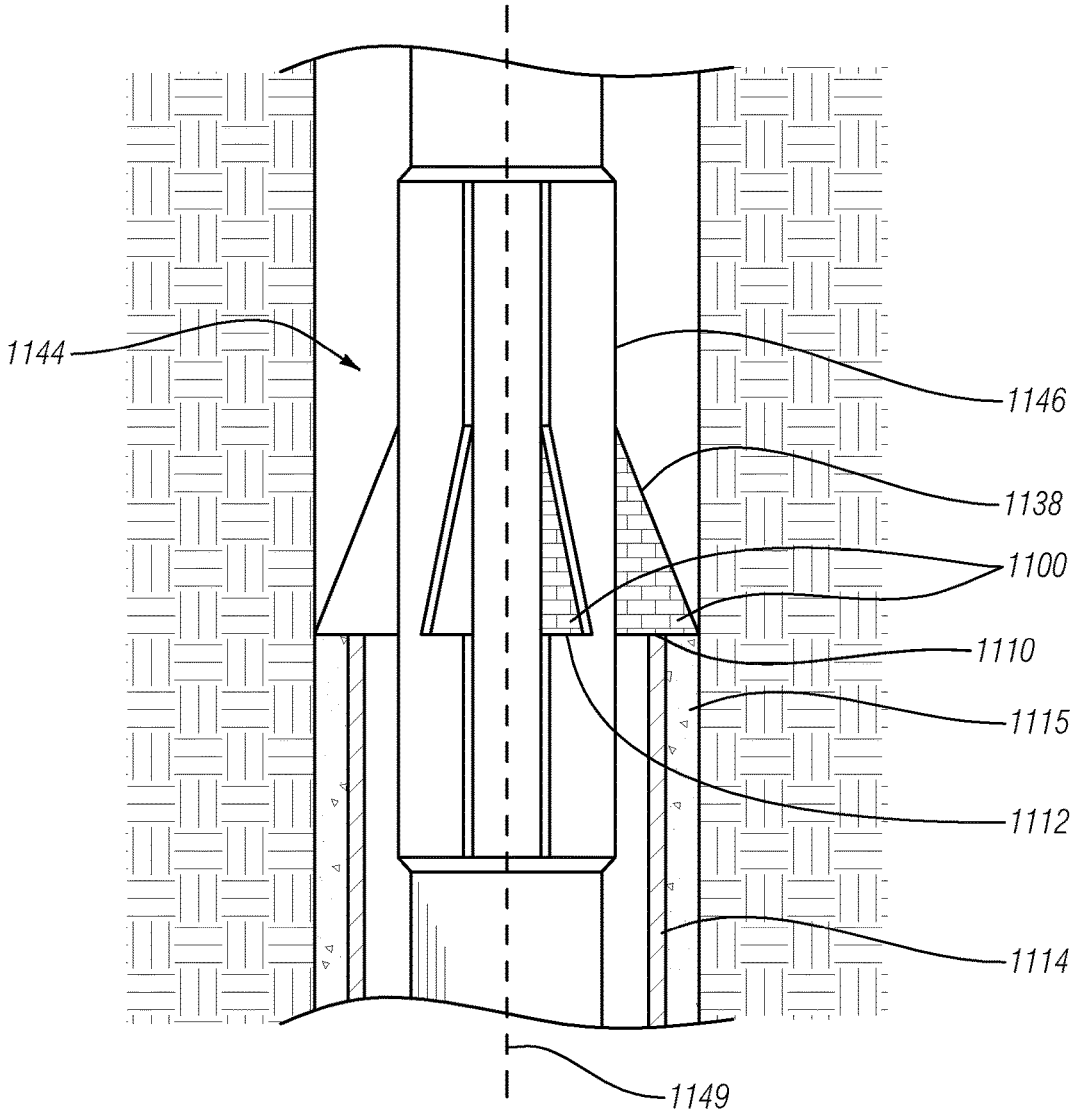
Figures 2, 11:
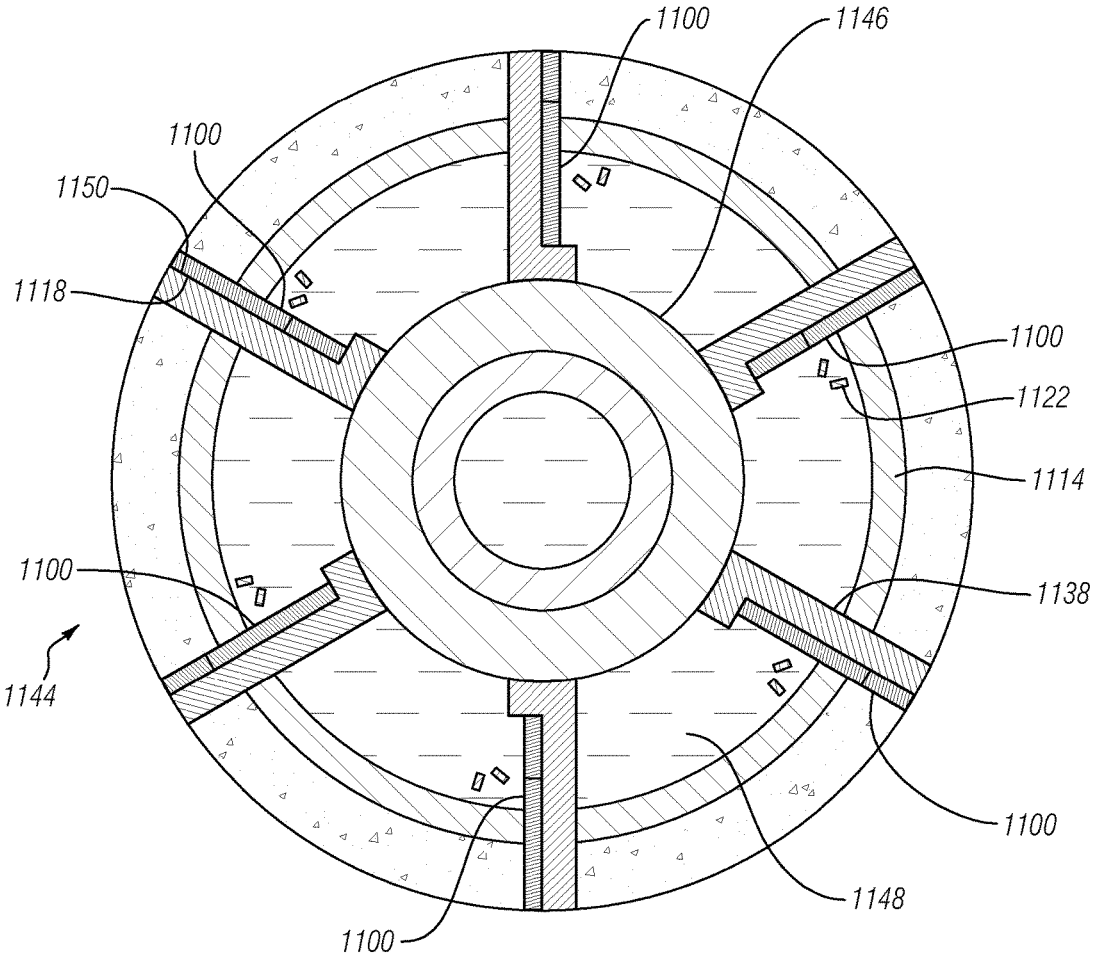

FIG. 11-1 is a side cutaway view of a section mill 1144 positioned in a wellbore casing 1114 and designed, arranged, or otherwise configured to mill at least a portion of the wellbore casing 1114 using a plurality of cutting inserts 1100, according to some embodiments of the present disclosure. In some embodiments, the wellbore casing 1114 may be held in place with a surrounding layer of cement 1115. The section mill 1144 may have a plurality of milling arms or knives—shown here as blades 1138—extending from a section mill body 1146. The blades 1138 may support forces on, or even apply forces to, the cutting inserts 1100. The section mill 1144 may have a longitudinal axis 1149 extending therethrough. The section mill body 1146, the blades 1138, or both, may rotate about the longitudinal axis 1149 and rotate the cutting inserts 1100 through an arcuate path. In some embodiments, the cutting inserts 1100 rotate through a circumferential path. In at least some embodiments, a cutting face of the cutting inserts 1100 may be oriented toward a direction of rotation, and a chip-breaking face of the cutting inserts 1100 may be facing toward a downhole or uphole direction, or a downhole or uphole end portion of the section mill 1144 (e.g., about perpendicular to the longitudinal axis 1149).

In some embodiments, the blades 1138 may extend radially outward and away from the longitudinal axis 1149, and one or more of the cutting inserts 1100 may be positioned to contact the wellbore casing 1114. When the section mill 1144 rotates and moves the blades 1138 relative to the wellbore casing 1114, the blades 1138 cause the cutting inserts 1100 to scrape against the wellbore casing 1114 and move the one or more cutting inserts 1100 by rotating in the direction of the cutting faces 1104. By applying weight to the section mill 1144, the cutting inserts 1100 can be compressed against the wellbore casing 1114 to create a depth of cut as the blades 1138 are rotated.

The cutting inserts 1100 may be oriented on the section mill 1144 such that a contact face 1110 is parallel to and/or the cutting edge 1112 is positioned along a face of the wellbore casing 1114 (e.g., an uphole or downhole facing face), and perpendicular to the longitudinal axis 1149. In other embodiments, the cutting inserts 1100 may be oriented on a blade 1138 of the section mill 1144 such that the contact face 1110 forms a relief angle relative to the wellbore casing 1114. In some embodiments, cutting faces of the cutting inserts may be oriented at neutral, positive, or negative rake angles relative to the wellbore casing 1114. For instance, a cutting insert 1100 at a non-zero, or non-neutral angle may bias movement of generated swarf in a radial direction relative to the longitudinal axis 1149, facilitating removal of the swarf as the section mill 1144 moves axially relative to the wellbore casing 1114 during milling.

FIG. 11-2 is a cross-sectional view of the section mill 1144 of FIG. 11-2. A cutting face (see cutting face 1004 of FIG. 10) of the one or more cutting inserts 1100 may remove material from the wellbore casing 1114, which may be work hardened, broken into chips 1122 as described herein, or both work hardened and broken into chips. The chips 1122 formed by the cutting inserts 1100 may be removed from the milling area by fluid 1148 flowing in an annulus between the inner surface of the wellbore casing 1114 and an outer surface of the body 1146 of the section mill 1144. A small size of the chips 1122 may allow the chips to be removed more efficiently than long ribbons (e.g., bird's nests) formed by other cutting inserts.

At least one cutting insert 1100 may be mounted to a blade 1138 such that the back face 1118 of the cutting insert 1100 is in directly or indirectly in contact with a blade face 1150. The blade face 1150 may be oriented to face the direction of rotation and may apply the motive force to the back face 1118 to the rotate and move the cutting insert 1100. In some embodiments, the blade 1138 may be in contact with a top face (e.g., top face 1019 of FIG. 10) of the cutting insert 1100 and may be configured to apply a downhole force to compress the cutting insert 1100 into or against the wellbore casing 1114. In other embodiments, the force applied to compress the cutting insert 1100 against the wellbore casing 1114 may be an uphole directed force (e.g., in an upwardly directed milling operation). Further, the force applied to the cutting insert 1100 may not be applied directly to a top face, but may instead be transferred or applied to the cutting insert 1100 in other manners (e.g., through a bond, fastener, or other coupling between the cutting insert 1100 and the blade 1138).

The section mill 1144 of FIGS. 11-1 and 11-2 may be used in a method within a wellbore that includes tripping the section mill 1144 into a wellbore. The section mill 1144 may include at least one blade 1138 having one or more cutting inserts 1100 coupled thereto. The cutting inserts 1100 may include any cutting insert as described herein. Where the section mill 1144 is selectively activatable, the at least one blade 1138 of the section mill 1144 may be selectively activated. The section mill 1144 and the at least one blade 1138 may be rotated within the wellbore, and the section mill 1144 and at least one blade 1138 may be moved axially within the wellbore. Such rotation and axial movement may cause the one or more cutting inserts 1100 to mill a section of wellbore casing 1114 in the casing. The combined rotation and axial movement can mill away an axial section of casing in either a downhole direction (by applying weight to the section mill 1144) or uphole direction (by pulling upwardly on the section mill 1144).

While FIGS. 11-1 and 11-2 are described with respect to a section mill 1144 which may have blades 1138 that can be selectively expanded at a downhole location to engage the wellbore casing 1114, make a cut-out in the wellbore casing 1114, and then face mill an axial distance along the casing 1114, in other embodiments the section mill 1114 may be representative of a casing mill having fixed blades 1138. In such an embodiment, the blades 1138 may be at a fixed radial position and rotated and moved axially downward in a wellbore to mill the wellbore casing 1114.

Figure 12:
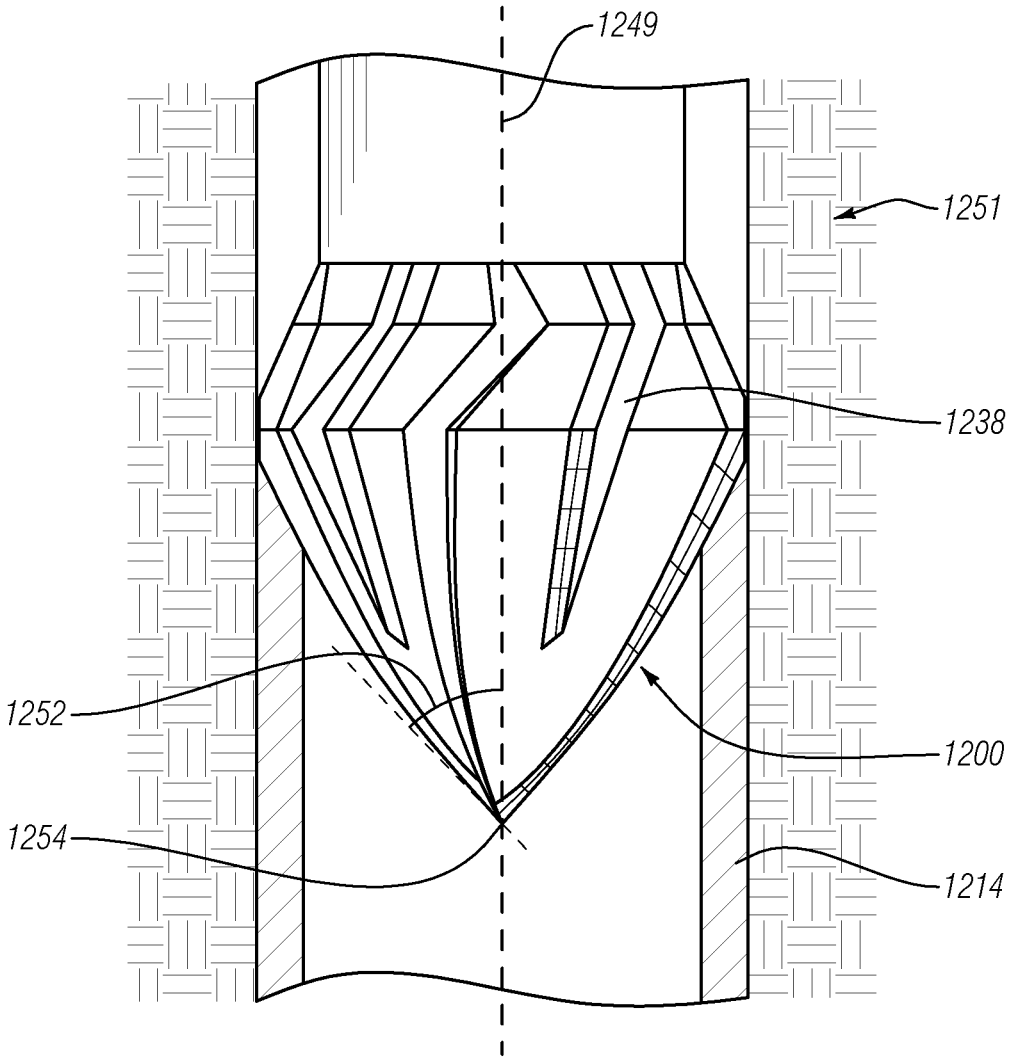
FIG. 12 is an axial cutaway view of a lead mill having one or more cutting inserts on each of a plurality blades positioned inside a wellbore casing, according to one or more embodiments of the present disclosure.

FIG. 12 is a side cutaway view of an example lead mill 1251 according to some embodiments of the present disclosure. In some embodiments, the lead mill 1251 may include a taper mill, window mill, or junk mill, and may be used within a wellbore casing 1214. For instance, the lead mill 1251 may include cutting inserts 1200 to mill the wellbore casing 1214, according to some embodiments of the present disclosure. The lead mill 1251 may include a plurality of blades 1238, which may each have one or more cutting inserts 1200 coupled thereto. At least a portion of the lead mill 1251 may rotate about a longitudinal axis 1249 of the lead mill 1251. In some embodiments, the blades 1238 of the lead mill 1251 may be oriented at a blade angle 1252 relative to the longitudinal axis 1249 of the lead mill 1251. For example, the lead mill 1251 may have a blade angle 1252 within a range having a lower value, an upper value, or both upper and lower values including any of 0°, 5°, 10°, 15°, 20°, or any value therebetween. For example, the blade angle 1252 may be between 0° and 20°. In another embodiment, the blade angle 1252 may be between 4° and 16°. In yet another embodiment, the blade angle 1252 may be between 8° and 12°. In still other embodiments, the blade angle 1252 may be less than 0° or greater than 20° along a full or partial length of the blades 1238.

In some embodiment, the blades 1238 may be of uniform length. In other embodiments, at least one of the blades 1238 may be longer than in the longitudinal direction than at least one other of the blades 1238. For example, a lead mill 1251 may have blades 1238 of alternating longitudinal lengths to allow for drilling fluid to flow therebetween and remove chips or other swarf during the milling process. In some embodiments, the blades 1238 may be substantially straight. In other embodiments, the blades 1238 may be curved. For example, at least one of the blades 1238 may be curved in the radial direction relative to the longitudinal axis 1249 of the lead mill 1251. In another example, at least one of the blades 1238 may be curved in the angular direction about the longitudinal axis 1249. In some embodiments, at least one of the blades 1238 may have one or more cutting inserts 1200 coupled thereto. The one or more cutting inserts 1200 may extend along a full or partial length of the blades 1238. For example, a cutting insert 1200 according to embodiments of the present disclosure may be affixed to the blade 1238 near or at the radially outward-most location of the blade 1238 relative to the longitudinal axis 1249, and a different or no cutting insert may be affixed to the blade 1238 closer to the longitudinal axis 1249 (e.g. at the downhole tip 1254 of the lead mill 1251). Additionally, while the lead mill 1251 is illustrated as extending the full outer diameter of the casing 1214, in other embodiments the lead mill 1251 may have a greater size (e.g., to mill or otherwise cut cement or formation) or a smaller size (e.g., to be used with a whipstock to mill a casing window).

As will be appreciated in view of the disclosure herein, ribbons of swarf (e.g., bird's nests) produced in milling may bind on themselves to restrict fluid flow or selective actuation/deactivation of a tool, may migrate into undesirable locations, or may produce other undesirable effects. A cutting insert according to the present disclosure may work harden swarf, break the swarf into smaller chips that are more readily managed and removed, or otherwise help manage the swarf for removal. Removal of swarf and other debris during milling may increase the operational lifetime of the cutting insert and milling tool, as well as increase milling speed and reduce milling time.

While embodiments of cutting inserts have been primarily described with reference to wellbore drilling operations, the cutting inserts described herein may be used in applications other than the milling of a wellbore casing. In other embodiments, cutting inserts according to the present disclosure may be used in a drilling application or outside a wellbore or other downhole environments used for the exploration or production of natural resources. For instance, cutting inserts of the present disclosure may be used in a borehole used for placement of utility lines. In other examples, cutting inserts of the present disclosure may be used in maintenance or manufacturing applications. Accordingly, the terms "wellbore," "borehole" and the like should not be interpreted to limit tools, systems, assemblies, or methods of the present disclosure to any particular industry, field, or environment.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. It should be understood that any directions or reference frames in the preceding description are merely relative directions or movements. For example, any references to "up" and "down" or "above" and "below" or "uphole" and "downhole" are merely descriptive of the relative position or movement of the related elements. Any element described in relation to an embodiment or a figure herein may be combinable with any element of any other embodiment or figure described herein. Terms such as "coupled," "connected," "affixed," and the like are intended to include direct connections between components, as well as indirect connections with one or more intervening components. The terms "optional," "may," and the like indicates that such components are present in some embodiments, but are excluded in other embodiments.

Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. Any stated values include at least the variation to be expected in a suitable manufacturing or production process, and may include values that are within 5%, within 1%, within 0.1%, or within 0.01% of a stated value. Where ranges are provided, such ranges are intended to encompass any sub-range within the range, or open-ended ranges starting or ending at any value within the specified range. The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A cutting insert for a milling tool, comprising:

a body including:

a back face configured to be coupled to a milling tool, the back face having a planar surface;

a contact face adjacent the back face, a cut-out portion of the body reducing a width of the contact face;

a cutting face opposite the back face and adjacent the contact face, a contact angle defined by the cutting face and the contact face being between 75° and 145°, the cut-out portion defining a cut-out width between the cutting face and a front face opposite the back face, the cut-out width being between 50% and 80% of a width of the body; and a chip-breaking face adjacent the cutting face, a face angle defined by the cutting face and the chip-breaking face being between 75° and 130°.

2. The cutting insert of claim 1, the cut-out portion being defined by a single cut-out in the body.

3. The cutting insert of claim 2, the single cut-out being at least partially spherical.

4. The cutting insert of claim 1, the cutting face and the chip-breaking face defining a continuous profile.

5. The cutting insert of claim 4, the continuous profile having a variable radius of curvature.

6. The cutting insert of claim 1, the contact angle being between 90° and 145°.

7. The cutting insert of claim 1, the cut-out portion extending a partial height of the body, the cut-out portion forming a lip between the chip-breaking face and a top face.

8. The cutting insert of claim 1, a line tangent to the cutting face being parallel to the back face, the cutting insert being continuous from the cutting face to the chip-breaking face, the cut-out portion defined by a single cut-out in the body located at the contact face, and the face angle being between 90° and 130°.

9. A cutting insert, comprising:

a body including an ultrahard material having a hardness greater than 80 Rockwell Hardness A (HRa) and including:

a back face; and a cut-out portion, the cut-out portion defining:

a cutting face;

a chip-breaking face;

a cut-out width between the cutting face and a front face opposite the back face, the cut-out width being between 50% and 80% of a width of the cutting insert; and a transition face between the cutting face and the chip-breaking face, the cutting face, chip-breaking face, and transition face defining a continuous partial elliptical or circular profile.

10. The cutting insert of claim 9, the cutting face and the chip-breaking face being curved.

11. The cutting insert of claim 9, the cutting face extending across an entire length of the body.

12. The cutting insert of claim 9, the profile being elliptical along at least a portion of the length of the body.

13. The cutting insert of claim 9, the cut-out portion further defining a cut-out height between a contact face and a top face opposite the cutting face, the cut-out height being between 50% and 80% of a height of the cutting insert.

14. The cutting insert of claim 9, the cut-out portion forming a cutting edge where a contact face and the cutting face are joined.

15. A downhole milling tool, comprising:

a mill body configured to rotate within a wellbore;

a plurality of blades coupled to the mill body and which extend radially outwardly from the mill body;

one or more cutting inserts coupled to the plurality of blades, at least one of the one or more cutting inserts including a cutting insert body formed at least partially of an ultrahard material having a hardness greater than 80 Rockwell Hardness A (HRa), the cutting insert body including:

a cutting face having a cutting edge, the cutting face being oriented toward a direction of rotation of the plurality of blades;

a chip-breaking face, a least a portion of which is oriented at an angle between 75° and 130° relative to at least a portion of the cutting face, the chip-breaking face and the cutting face being defined by a cut-out in the cutting insert body, the cut-out extending a partial height and partial width of the cutting insert body, the cut-out reducing a thickness of the one or more cutting inserts at the contact face, the cut-out forming a lip between the chip-breaking face and a top face, the chip-breaking face and the cutting face being continuous;

a back face opposing the cutting face and coupled to at least one of the plurality of blades such that the cutting face is oriented toward a direction of rotation of the mill body and the chip-breaking face is oriented toward a downhole end portion of the mill body, the back face including a planar surface; and a contact face adjacent the back face, a contact angle defined by the cutting face and the contact face being between 75° and 145°.

16. The downhole milling tool of claim 15, the cutting face being at a relief angle of between 0° and 20° relative to a blade face of the blade.

17. The downhole milling tool of claim 15, the at least one of the one or more cutting inserts being coupled to one of the plurality of blades at a negative rake angle.

18. The downhole milling tool of claim 15, the cutting face extending axially upwardly from the cutting edge toward an uphole end portion of the mill body.

19. The downhole milling tool of claim 15, the cut-out being defined by a single cut-out, and the single cut-out extending a height that is between 50% and 80% of the height of the cutting insert body.

20. The downhole milling tool of claim 15, wherein:

the back face is rectangular;

the cutting insert body includes a single chip-breaking face;

the cut-out is defined by a single cut-out in the cutting insert body, the single cut-out having a width that is between 50% and 80% of a width of the cutting insert body and a height that is between 50% and 80% of a height of the cutting insert body;

the contact face is planar and has a width that is between 50% and 80% of the width of the cutting insert body; and at an interface between the contact face and the cutting face, the cutting face is oriented at a negative rake angle that is between −2° and −20°.

21. The downhole milling tool of claim 15, the cut-out defining a cut-out width between the cutting face and a front face opposite the back face, the cut-out width being between 50% and 80% of a width of the cutting insert.

* * * * *